US005672271A

United States Patent [19]

Dye

[11] Patent Number: 5,672,271

[45] Date of Patent: Sep. 30, 1997

[54] COLLAPSIBLE POOL SKIMMER APPARATUS

[76] Inventor: Terry Dye, 7190 Crail Ct., Citrus Heights, Calif. 95610

[21] Appl. No.: 636,325

[22] Filed: Apr. 22, 1996

[51] Int. Cl.[6] ..... E04H 4/16

[52] U.S. Cl. ..... 210/169; 210/232; 210/405; 210/416.2; 210/421; 210/456

[58] Field of Search ..... 210/169, 232, 210/405, 406, 416.2, 420, 421, 456

[56] References Cited

U.S. PATENT DOCUMENTS

| | | | |
|---|---|---|---|
| 2,980,256 | 4/1961 | Nash . | |
| 3,469,700 | 9/1969 | Johnson . | |
| 3,508,661 | 4/1970 | Diemond et al. . | |
| 3,616,916 | 11/1971 | Greene . | |
| 3,701,427 | 10/1972 | Howard | 210/169 |
| 4,059,519 | 11/1977 | Zieg . | |
| 4,154,679 | 5/1979 | Farage | 210/169 |
| 4,325,150 | 4/1982 | Buddy | 210/169 |
| 4,348,281 | 9/1982 | Perry et al. | 210/169 |
| 4,737,279 | 4/1988 | Lewis | 210/169 |
| 4,746,424 | 5/1988 | Drew | 210/169 |
| 4,826,591 | 5/1989 | Macia | 210/169 |
| 4,889,622 | 12/1989 | Newcombe-Bond | 210/169 |
| 4,995,977 | 2/1991 | Hilgendorff et al. | 210/456 |
| 5,122,285 | 6/1992 | Tartal . | |
| 5,202,020 | 4/1993 | Desjoyaux et al. . | |

FOREIGN PATENT DOCUMENTS 957620 11/1974 Canada .

*Primary Examiner*—Neil McCarthy
*Assistant Examiner*—Theodore M. Green
*Attorney, Agent, or Firm*—John P. O'Banion

[57] ABSTRACT

A pool skimmer apparatus having a skimmer basket with an upper ring and a mesh bag depending therefrom. A plurality of risers on the upper ring provide an annular gap between the upper ring and the lip of a pool skimmer receptacle which provides an escape route for water flow when the mesh bag becomes clogged with debris, thereby avoiding damage to the pool circulation pump. A speed accelerator plate detachably couples to the upper ring in either a first, regular flow position or a second, vortex-generating accelerated flow position, to allow skimming or filtering of pool water at different rates.

19 Claims, 4 Drawing Sheets

COLLAPSIBLE POOL SKIMMER APPARATUS

BACKGROUND OF THE INVENTION

1. Field of the Invention

This invention pertains generally to fluid filtering devices and methods, and more particularly to a pool skimmer apparatus which avoids water pump damage due to clogged filter meshes and which allows control of water flow velocity through the skimmer.

2. Description of the Background Art

Pool skimmers are commonly used to remove floating debris such as fallen leaves, hair, lint, and drowned insects from pool water. Pool skimmers typically comprise a meshed basket shaped member through which pool water flows, with the mesh serving to trap debris present in the flowing pool water. Pool skimmers are usually located in a recessed area in a wall at the side of a swimming pool, With overflow water from the pool accessing the skimmer through a floating dam or flapper valve. A water pump positioned below or otherwise downstream from the skimmer draws water through the mesh, which entraps water-born debris. The mesh is periodically cleaned to remove the trapped debris.

Previously developed pool skimmer devices and pool skimming methods have proved deficient in various respects. For example, currently known pool skimmers, when clogged with debris, interrupt the flow of water to the pool circulation pump and can result in damage to the pump. Further, the rate of water flow through conventional pool skimmers cannot readily be varied or controlled without varying the pump rate, and thus skimming or filtering rates cannot be readily accelerated to accommodate increased pool surface debris levels due to heavy pool use, windy conditions or other causes. Additionally, cylindrical or basket shaped pool skimmers are bulky and require substantial storage and shelf space by sellers of pool equipment. Yet another deficiency is that currently used pool skimmer meshes tend to be difficult to clean.

Accordingly, there is a need for a pool skimmer apparatus which provides for water flow through the skimmer when the filter or mesh surfaces are clogged, which avoids damaging water pumps used with pool skimmers, which provides for variable water flow rates, which is collapsible and can be stored in a small space, and which can be easily cleaned. The present invention satisfies these needs, as well as others, and generally overcomes the deficiencies found in the background art.

SUMMARY OF THE INVENTION

The present invention is a pool skimmer apparatus which avoids pump damage due to clogged skimmer meshes, which is reversible, which provides for accelerated skimming rates when desired, and which is collapsible and can be stored in a small space. In its most general terms, the invention comprises a collapsible basket of screen or mesh material with an open top, an upper ring associated with the top of the basket, vortex means, adjustably and detachably coupled to the upper ring, for providing accelerated flow rates, and flow escape means for allowing water to exit the basket when the net is clogged. The pool skimmer apparatus is used within the standard skimmer receptacles provided in the side walls of conventional in-ground pools, and with the standard skimmer receptacles for above ground pools.

By way of example and not of limitation, the collapsible basket is of generally cylindrical structure and configuration with an open top, and is made of a flexible or resilient mesh or net of metal or polymeric material. The basket preferably includes a weighted, disc-shaped bottom to overcome buoyancy associated with the basket. The upper ring is preferably of annular structure and configuration and includes first and second surfaces. Preferably, the mesh of the basket is joined to the upper ring along an inner edge of the ring. The collapsible basket preferably can be inverted in orientation relative to the top ring for easy cleaning of the mesh.

The vortex means preferably comprises a disc-shaped speed accelerator plate or lid having a generally semicircular shaped opening. The speed accelerator plate detachably couples to the upper ring in either a first, regular flow position or a second, accelerated flow position. In the first position the curved edge of the semicircular opening is oriented towards the direction of water flow to provide a generally slower flow of water to the basket. In the second position an end of the semicircular opening is facing towards the direction of water flow, causing a vortex effect as water passes through the semicircular opening and into the basket, thereby providing for accelerated or faster flow rates through the basket for faster skimming or filtering action. The speed accelerator plate of the vortex means reversibly and detachably snap fits onto the top ring of the basket in either the first or second position as desired. Alternatively, the disc shaped lid may be slidably attached to the upper ring so that the lid may be rotated between the first and second positions without detachment from the top ring of the basket.

The flow escape means preferably comprises a plurality of risers or spaces included on the first and second surfaces of the upper ring. When the basket of the pool skimmer apparatus is placed within the skimmer receptacle in the pool wall, the risers hold the upper ring slightly above the lip of the receptacle to define a flat circular opening extending laterally about the top of the basket between the upper ring of the basket and the receptacle lip. The size of the risers may be varied to provide wider or narrower circular openings. The circular opening is oriented in a direction which is generally perpendicular or normal to the direction of water flow through the pool skimmer apparatus, and thus does not substantially affect the flow unless the mesh of the basket becomes clogged, whereupon the circular opening provides an alternate route for water to flow to prevent pump damage. The flat, circular opening of the flow escape means may alternatively comprise a plurality of channels within the upper ring and extending laterally through the upper ring.

The pool skimmer apparatus comprising the invention is used by attaching the speed accelerator plate onto the upper ring of the basket with the semicircular opening oriented in the first, regular flow position or second, accelerated flow position as desired, and placing the basket in the receptacle or housing provided in the pool wall for pool skimmers. The weighted disc at the bottom of the basket overcomes any buoyancy associated with the basket and allows the basket to extend to its un-collapsed cylindrical shape within the receptacle to provide a maximum surface area of mesh. Water is drawn past the floating barrier or flapper and into the pool skimmer apparatus by action of the pool circulation pump in a conventional manner. Water enters the pool skimmer apparatus through the semicircular opening in speed accelerator plate, and exits through the mesh of the basket, with the mesh acting as a sieve to trap or collect water-born debris within the mesh. Alternatively, the apparatus can be used without the accelerator plate in a similar manner.

The pool skimmer apparatus is periodically withdrawn from the receptacle or recess in the pool wall, the speed accelerator plate is removed, and debris is cleaned from the basket. Since basket of the pool skimmer apparatus of the present invention is collapsible and can be inverted, cleaning is facilitated since persons can disengage the disc shaped top from the top ring, invert the basket mesh, and shake out the debris. Since there are risers provided on both surfaces of the upper ring, the basket can be replaced within the receptacle in the inverted position after cleaning. If the mesh becomes clogged with debris such that flow through the mesh is not possible, the laterally extending opening between the upper ring and receptacle lip allows water flow to escape, thereby avoiding overheating and damage to the water pump. If pool conditions change such that an increased skimming or filtering rate is desirable, related above, the speed accelerator plate is re-attached to the upper ring in the second, vortex generating position for accelerated flow wherein one of the ends of the semicircular opening is pointing in the flow direction.

An object of the invention is to provide a pool skimmer apparatus having a mesh basket which is collapsible.

Another object of the invention is to provide a pool skimmer apparatus wherein the basket is reversible.

Another object of the invention is to provide a pool skimmer apparatus wherein the mesh basket can be inverted for facile cleaning.

Another object of the invention is to provide a pool skimmer apparatus which allows water flow to escape from the apparatus when clogged to prevent damage to pool circulation pumps.

Another object of the invention is to provide a pool skimmer apparatus which can be adjusted to allow an accelerated water flow rate through the mesh basket.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus generally shown in FIG. 1 through FIG. 5. It will be appreciated that the apparatus may vary as to configuration and as to details of the parts without departing from the basic concepts as disclosed herein. While the invention is described in terms of a pool skimmer, it should be readily apparent to those skilled in the art that the apparatus comprising the invention may also be used for filtering of water or other liquids in storage tanks or for other various liquid filtering or cleaning applications.

Figure 1:
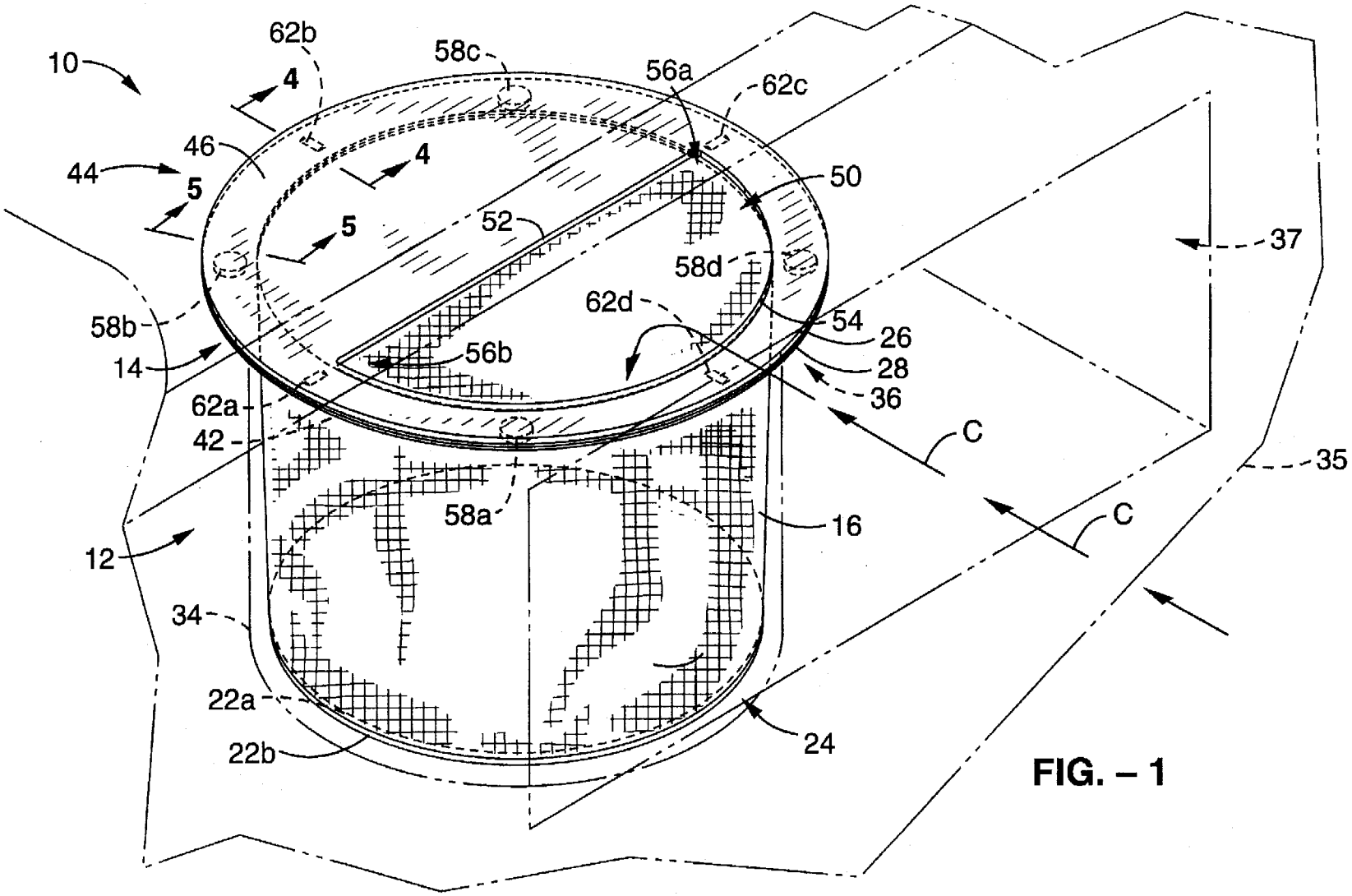
FIG. 1 is a perspective view of a pool skimmer apparatus in accordance with the invention wherein the accelerator plate is shown in a regular flow position, and a portion of a pool wall is shown in phantom.
Figure 2:
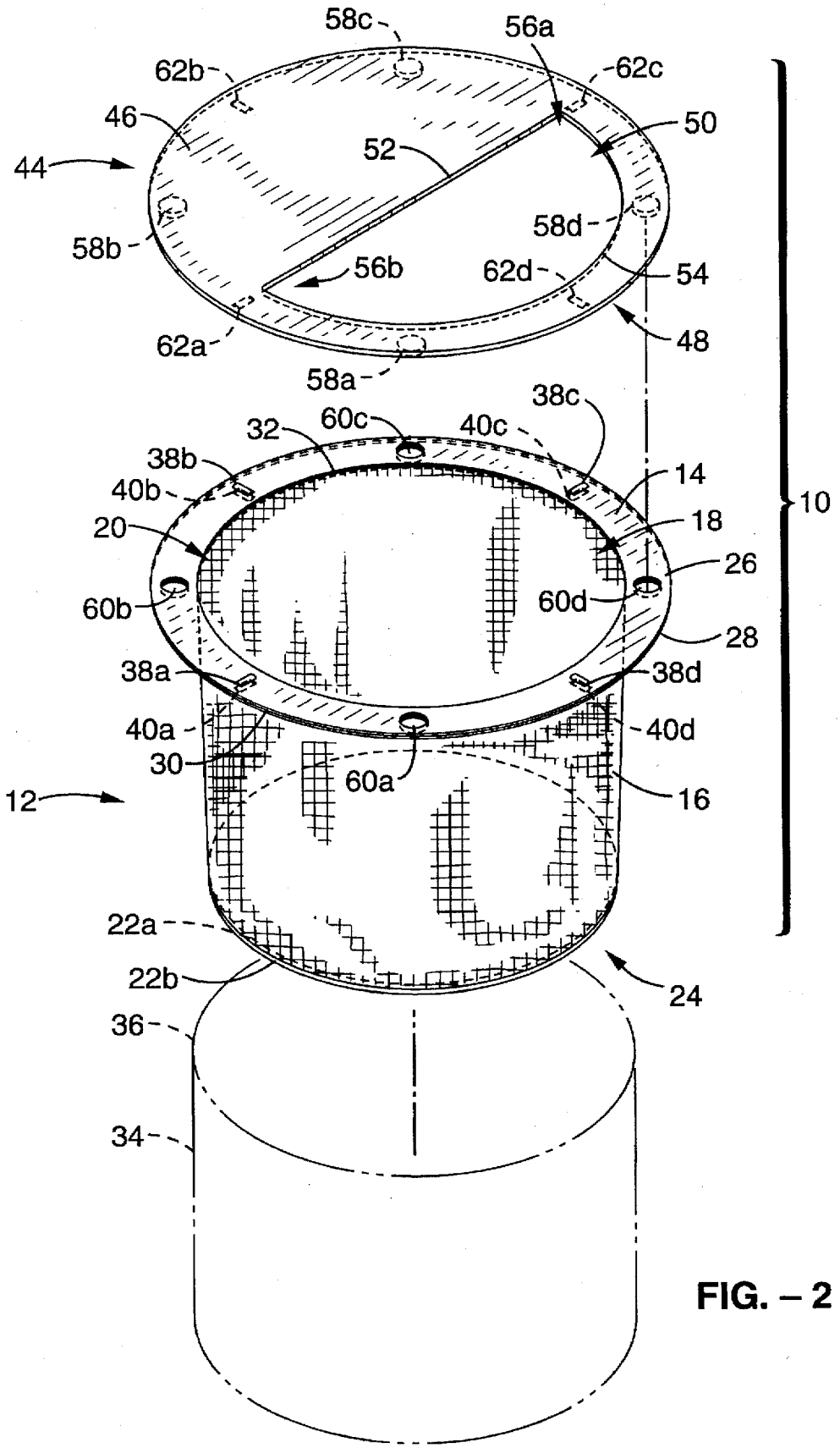
FIG. 2 is an exploded view of the pool skimmer apparatus shown in FIG. 1.

Referring now to FIG. 1 and FIG. 2, there is shown a pool skimmer apparatus 10 in accordance with the invention. The apparatus 10 includes a collapsible skimmer basket 12 having an upper or top ring 14, and a bag 16 depending from upper ring 14. Bag 16 is preferably of generally cylindrical structure and configuration, and may vary in size and shape according to particular needs or applications of the invention. Bag 16 is made of a flexible, resilient mesh, net, or screen material, or a material which is otherwise porous or permeable to water and other fluids and which allows basket 12 to be collapsible. Preferably, bag 16 is fabricated of mesh made from a flexible, resilient, light weight polymeric material or corrosion resistant metal. An opening 18 (FIG. 2) is included at a top end 20 (FIG. 2) of bag 16, with opening 18 preferably of circular structure and configuration as shown. A pair of weighted disks *22a, 22b* are preferably included at a bottom end 24 of bag 16, with bottom end 24 of bag 16 held between disks *22a, 22b*. Weighted disks overcome any buoyancy associated with the mesh material of bag 16 and/or upper ring 14 and provide weight to extend bag 16 downward to maximize the available surface area of mesh for filtering, as described below. A single weighted disk, rather than the dual disk configuration of *22a, 22b* may alternatively be used in association with bottom end 24 of bag 16.

Referring more particularly to FIG. 2, upper ring 14 is preferably of annular structure and configuration, and is flattened in shape to provide a first or top surface 26 and a second or bottom surface 28. Upper ring 14 also preferably includes an outer edge 30 and an inner edge 32. Top end 20 of bag 16 is preferably attached to the inner edge 32 of upper ring 14, such that opening 18 in bag 16 is generally adjacent to upper ring 14. Bag 16 may be joined to upper ring 14 by adhesives, melt bonding, clip or clamping arrangements, or other standard attachment means.

Skimmer basket 12 is generally used in conjunction with a conventional pool skimmer receptacle 34 which is typically provided within a pool wall 35 of in-ground pools, or which is located externally for above-ground pools. Receptacle 34 includes an upper lip or edge 36, and is in flow communication with a pool circulation pump (not shown) located below or otherwise downstream from receptacle 34. Pool water reaches receptacle in a standard manner through an opening 37 in pool wall 35, and is drawn towards and through receptacle 34 by the action of the pump. A floating dam, weir, barrier, or flapper (not shown) is commonly included in opening 37 to regulate the water flow reaching receptacle 34. Basket 12 fits within receptacle such that upper ring 14 sits or rests on receptacle lip 36, and with bag 16 and bottom disc 22 depending or extending downward into receptacle 34 as shown. Since basket 12 is reversible, first or second side 26, 28 of upper ring 14 may be adjacent receptacle lip 36 depending upon the orientation of bag 16 relative to upper ring 14. As shown, basket 12 is positioned with second edge 28 adjacent lip 36. Pool water is drawn through the top opening 18 and mesh of bag 16 by the action of the pump, and the mesh of bag 16 traps or catches water-born debris. Water which has filtered through bag 16 is then returned to the pool by the pump.

Figure 5:
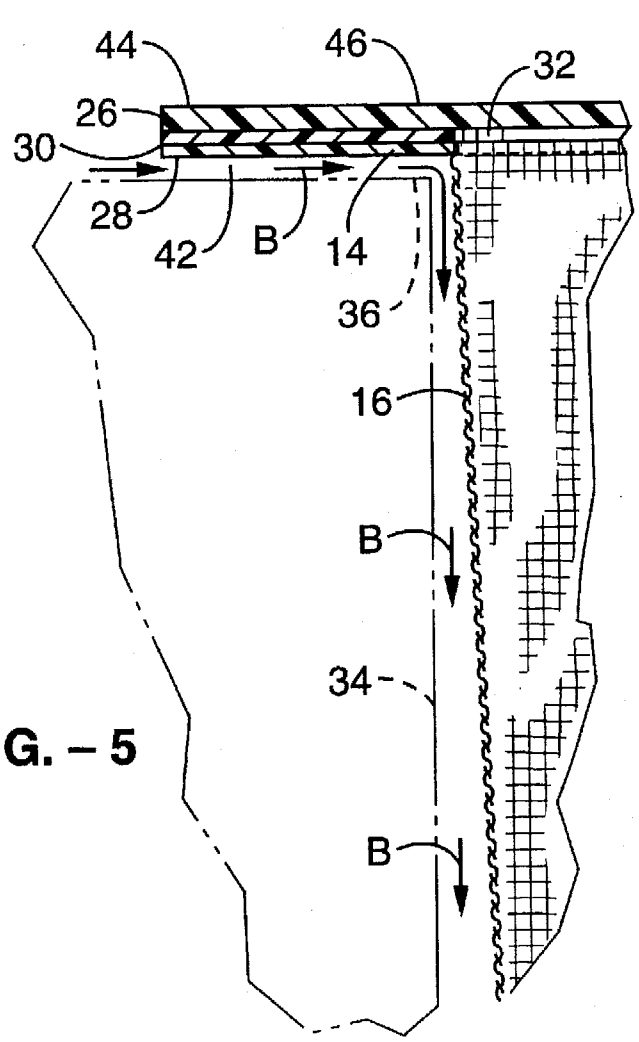
FIG. 5 is a cross-sectional view of the pool skimmer apparatus of FIG. 1 taken through line 5—5.
Figure 4:
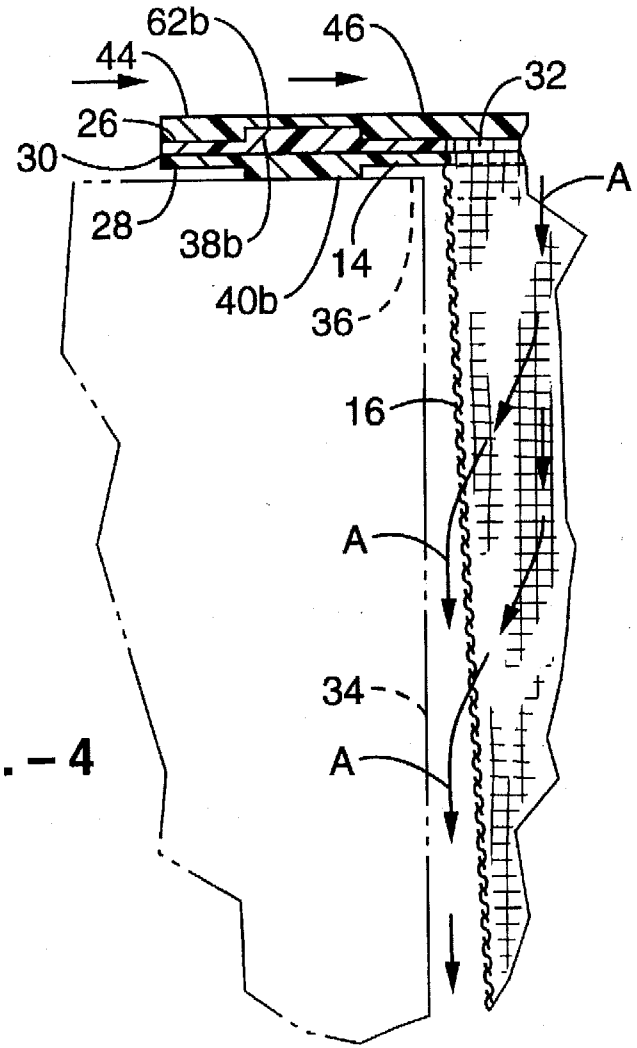
FIG. 4 is a cross-sectional view of the pool skimmer apparatus of FIG. 1 taken through line 4—4.

As mentioned above, conventional pool skimmers have proven deficient in that, when they becomes clogged with debris, water flow to the pool circulation pump is blocked, which can cause overheating and damage to the pool circulation pump. The present invention thus provides flow escape means for allowing water to exit the basket 12 when the net or mesh of bag 16 is clogged with debris. The flow escape means preferably comprises a plurality of risers or spacers 38*a*, 38*b*, 38*c*, 38*d*, shown in FIG. 2, which are included on first (upper) surface 26 of upper ring 14, and a plurality of riser or spacers 40*a*, 40*b*, 40*c*, 40*d*, also shown in FIG. 2, on second (lower) surface 28 of ring 14. Risers 40*a*, 40*b*, 40*c*, 40*d* prevent surface 28 of upper ring 14 from contacting lip 36 and thus provide an annular gap, aperture or space 42 between upper ring 14 and receptacle lip 36 through which water may by-pass skimmer basket 12 when mesh bag 16 becomes clogged. Referring more particularly to FIG. 4 and FIG. 5, when the mesh of bag 16 is not clogged, water is generally drawn through the mesh, as indicated by arrows A, with bag 16 retaining debris filtered from the water. When the mesh of bag 16 becomes clogged with leaves or other water carried debris, annular aperture 42 provides a route, shown by arrows B in FIG. 5, through which water may flow to the pool circulation pump that by-passes the clogged mesh of basket 16 and travels between basket 16 and receptacle 34, thereby avoiding damage to the pump which might otherwise occur.

Basket 12 is generally reversible, and when basket 12 is inverted relative to the position shown in FIG. 1 through FIG. 5, first surface 26 of upper ring 14 is adjacent receptacle lip 36, and risers 38*a*, 38*b*, 38*c*, 38*d* provide an annular gap or aperture through which water flow may escape when mesh bag 16 is clogged. Thus, the flow escape means of the invention is operative when basket 12 is used with surface 26 of upper ring 14 adjacent receptacle lip 36, or when surface 28 of upper ring 14 is adjacent receptacle lip 36 as shown. The flow escape means of the invention may alternatively comprise a plurality channels (not shown) which are internal to upper ring 14 and extend from outer edge 30 to points on first and second surfaces 26, 28 such that water passing through the channels bypasses mesh bag 16.

Also provided with the present invention are vortex means for providing accelerated flow rams through skimmer basket 12. The vortex means preferably comprises a speed accelerator plate 44 which detachably couples to upper ring 14 of skimmer basket 12. Speed accelerator plate 44 includes upper and lower surfaces 46, 48 respectively, and has a generally semicircular opening 50 extending through plate 44. Opening 50 has a flat edge 52, a rounded edge 54, and a pair of corners 56*a*, 56*b*. A plurality of studs 58*a*, 58*b*, 58*c*, 58*c* are included on the lower surface 48 of speed accelerator plate 44, with studs 58*a*, 58*b*, 58*c*, 58*c* reversibly snap fitting into a plurality of matching or corresponding openings 60*a*, 60*b*, 60*c*, 60*d* (FIG. 2) in upper ring 14. A plurality of recesses 62*a*, 62*b*, 62*c*, 62*d* are provided in lower surface 48 of speed accelerator plate 44 to accommodate risers 38*a*, 38*b*, 38*c*, 38*d* in first surface 26 of upper ring 14 (or risers 40*a*, 40*b*, 40*c*, 40*b* on second surface 28 of upper ring 14 when basket 12 is inverted).

Figure 3:
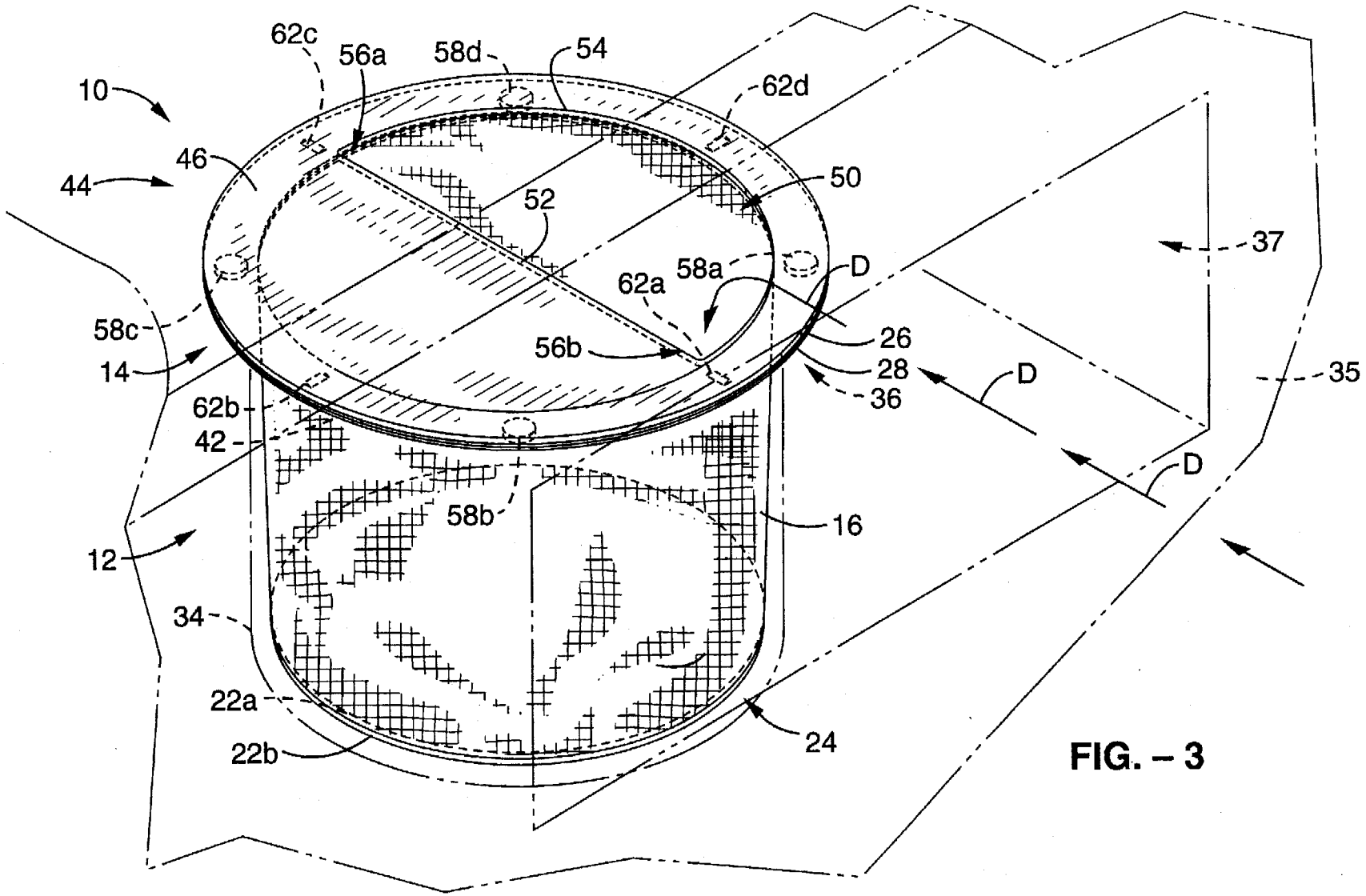
FIG. 3 is a perspective view of a pool skimmer apparatus of FIG. 1 with the accelerator plate shown in an accelerated flow position.

Referring more particularly to FIG. 1 and FIG. 3, the speed accelerator plate 44 detachably couples to the upper ring 14 in either a first, regular flow position shown in FIG. 1, or a second, accelerated flow position as shown in FIG. 3. In the first or regular flow position, the curved edge 54 of semicircular opening 50 in speed accelerator plate 44 is oriented towards the direction of water flow, shown by arrows C, to provide a flow of water through opening 50 and into basket 12. The direction of water flow as shown by arrow C is thus generally normal to flat edge 52 of opening 50 while speed accelerator plate 44 is in the first position. In the second or accelerated position shown in FIG. 3, an end 56*a* (or 56*b*) of semicircular opening 50 in speed accelerator plate 44 is oriented towards the direction of water flow, indicated generally by arrows D. The shape and orientation of semicircular opening 50 in the second position cause a vortex effect as water passes through semicircular opening 50 and into basket 12, thereby providing an accelerated or faster flow rate through basket 12 than is provided by the first position described above.

Referring to FIG. 1 through FIG. 5 generally, speed accelerator plate 44 reversibly and detachably snap fits onto upper ring 14 of the basket 12 by means of snap fitting studs 58*a*, 58*b*, 58*c*, 58*c* reversibly snap fitting into openings 60*a*, 60*b*, 60*c*, 60*d* in upper ring 14, as related above. Preferably, studs 58*a*, 58*b*, 58*c*, 58*c* are arranged on lower surface 48 of speed accelerator plate 44 such that the studs are generally at ninety degree intervals about the circumference of plate 44 and positioned to allow snap fitting of plate into either the first or second position. Likewise, openings 60*a*, 60*b*, 60*c*, 60*d* in upper ring 14 are positioned about upper ring 14 at generally ninety degree intervals. By selectively snap fitting the appropriate studs 58*a*, 58*b*, 58*c*, 58*c* into appropriate openings 60*a*, 60*b*, 60*c*, 60*d*, speed accelerator plate 44 may be attached to upper ring 14 in either the first, regular flow or second, accelerated flow positions. Alternatively, if receptacle 34 is structured and configured such that basket 12 can be rotated within receptacle 36, basket 12, together with the attached speed accelerator plate 44, may be rotatably positioned within receptacle 34 in the first, regular flow position or second, accelerated flow position as desired. It is further contemplated that speed accelerator plate 44 can be rotatably coupled to upper ring 14 by an annular ridge (not shown) on lower surface 48 of plate 44 which is slidably received and retained by an annular groove or channel (not shown) in first and/or second surface 26, 28 of upper ring 14. Various other means for detachably coupling speed accelerator plate 44 to upper ring 14 in the first, regular flow position and second, accelerated flow positions will suggest themselves to those skilled in the art.

The vortex means of the invention may alternatively comprise various vortex generating structural features used in association with speed accelerator plate 44. For example, one or more curved, spiral, or turbinate water conducting tubes or channels may be provided on accelerator plate and positioned relative to the water flow direction to induce a vortex in basket 12 in generally the same manner that a vortex is obtained in a bucket with a suitably positioned garden hose. Such vortex generating features may be associated with upper ring 14 in ways which do not require the use of speed accelerator plate 44. For example, a curved tube could be detachably coupled directly to upper ring in a way to direct water flow into basket 12 such that a vortex is formed therein. However, the use of a suitably oriented semicircular opening in a plate as described above provides a flow accelerating vortex in basket 12 in a simple and straightforward fashion, and thus is presently preferred.

The present invention is used by placing skimmer basket 12 within receptacle 34, and allowing weighted disc 22 to extend mesh bag 16 within receptacle to provide a maximum mesh area for filtering or skimming. Water is drawn into basket 12 through opening 50 in plate 44, through top opening 18 of bag 16 and through the mesh of bag 16, with bag 16 trapping or retaining debris from the water. Filtered water which passes through mesh bag 16 is then returned to the pool by action of the pool circulation pump. The skimmer basket 12 may be used without speed accelerator plate 44 if desired, or with speed accelerator plate 44 attached to upper ring 14 in either the first, regular flow position or second, accelerated flow position in the manner described above. The second, accelerated flow position allows faster skimming or filtering action, and may be desirable under conditions wherein increased debris levels occur in a swimming pool due to heavy use or increased levels of wind-born leaves and dirt. Skimmer basket 12 may be cleaned by removing basket 12 from receptacle 34, detaching speed accelerator plate 44, and shaking or otherwise cleaning accumulated debris out of mesh bag 16. Basket 12 is reversible, and thus mesh bag can be inverted or reversed for cleaning so that accumulated debris is on the exterior of bag 16, which facilitates cleaning. If the pool skimmer apparatus is not cleaned and mesh bag 16 becomes clogged, water flow can escape through annular aperture 42 and by-pass skimmer basket 12, as described above, so that overheating and damage to the pool circulation pump are avoided.

Accordingly, it will be seen that this invention provides a pool skimmer apparatus which allows skimming at accelerated rates, which will not damage pool circulation pumps when the apparatus becomes clogged, and which is easily cleaned. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A liquid skimmer apparatus, comprising:

(a) a collapsible skimmer basket, said basket including an upper ring, said basket including a mesh bag depending from said upper ring, said bag having an opening adjacent said upper ring;

(b) a weighted disk, said weighted disk attached to a bottom end of said mesh bag; and (c) a plurality of risers, said risers included on said upper ring, said risers defining an annular opening between said upper ring and a skimmer receptacle lip.

2. A liquid skimmer apparatus as recited in claim 1, further comprising vortex means, associated with said upper ring, for providing accelerated liquid flow through said basket.

3. A liquid skimmer apparatus as recited in claim 2, wherein said vortex means comprises a speed accelerator plate, said speed accelerator plate having a semicircular opening, said speed accelerator plate planarly aligned with said upper ring, said speed accelerator plate detachably coupled to said upper ring.

4. A liquid skimmer apparatus as recited in claim 3, wherein said speed accelerator plate detachably and adjustably couples to said upper ring in a first, regular flow position wherein a rounded edge of said semicircular opening is oriented towards the direction of liquid flow, and a second, accelerated flow position wherein a corner of said semicircular opening is oriented towards said direction of liquid flow.

5. A liquid skimmer apparatus as recited in claim 1, wherein said upper ring includes a first surface and a second surface, said plurality of risers included on said first and second surfaces of said upper ring.

6. A pool skimmer apparatus, comprising:

(a) a collapsible skimmer basket, said basket including an upper ring, said basket including a mesh bag depending from said upper ring, said bag having an opening adjacent said upper ring; and (b) a plurality of risers, said risers included on said upper ring, said risers defining an annular opening between said upper ring and a skimmer receptacle lip.

7. A pool skimmer apparatus as recited in claim 6, further comprising a weighted disk, said weighted disk attached to a bottom end of said mesh bag.

8. A pool skimmer apparatus as recited in claim 6, further comprising vortex means, associated with said upper ring, for providing accelerated water flow through said basket.

9. A pool skimmer apparatus as recited in claim 8, wherein said vortex means comprises a speed accelerator plate, said speed accelerator plate having a semicircular opening, said speed accelerator plate planarly aligned with said upper ring, said speed accelerator plate detachably coupled to said upper ring.

10. A pool skimmer apparatus as recited in claim 8, wherein said speed accelerator plate detachably and adjustably couples to said upper ring in a first, regular flow position wherein a rounded edge of said semicircular opening is oriented towards the direction of water flow, and a second, accelerated flow position wherein a corner of said semicircular opening is oriented towards said direction of water flow.

11. A pool skimmer apparatus as recited in claim 6, wherein said upper ring includes a first surface and a second surface, said plurality of risers included on said first and second surfaces of said upper ring.

12. A pool skimmer apparatus, comprising:

(a) a collapsible skimmer basket, said basket including an upper ring, said basket including a mesh bag depending from said upper ring, said bag having an opening adjacent said upper ring;

(b) a plurality of risers, said risers included on said upper ring, said risers defining an annular opening between said upper ring and a skimmer receptacle lip; and (c) vortex means, adjacent said upper ring, for providing accelerated water flow through said basket.

13. A pool skimmer apparatus as recited in claim 12, further comprising a weighted disk, said weighted disk attached to a bottom end of said mesh bag.

14. A pool skimmer apparatus as recited in claim 12, wherein said upper ring includes a first surface and a second surface, said plurality of risers included on said first and second surfaces of said upper ring.

15. A pool skimmer apparatus as recited in claim 12, wherein said vortex means comprises a speed accelerator plate, said speed accelerator plate having a semicircular opening, said speed accelerator plate planarly aligned with said upper ring, said speed accelerator plate detachably coupled to said upper ring.

16. A pool skimmer apparatus as recited in claim 15, wherein said speed accelerator plate detachably and adjustably couples to said upper ring in a first, regular flow position wherein a rounded edge of said semicircular opening is oriented towards the direction of water flow, and a second, accelerated flow position wherein a corner of said semicircular opening is oriented towards said direction of water flow.

17. A liquid skimmer apparatus, comprising:

(a) a collapsible skimmer basket, said basket including an upper ring, said basket including a mesh bag depending from said upper ring, said bag having an opening adjacent said upper ring;

(b) a weighted disk, said weighted disk attached to a bottom end of said mesh bag; and (c) a speed accelerator plate, said speed accelerator plate having a semicircular opening, said speed accelerator plate planarly aligned with said upper ring, said speed accelerator plate detachably coupled to said upper ring;

(d) wherein said speed accelerator plate detachably and adjustably couples to said upper ring in a first, regular flow position wherein a rounded edge of said semicircular opening is oriented towards the direction of liquid flow, and a second, accelerated flow position wherein a corner of said semicircular opening is oriented towards said direction of liquid flow.

18. A pool skimmer apparatus, comprising:

(a) a collapsible skimmer basket, said basket including an upper ring, said basket including a mesh bag depending from said upper ring, said bag having an opening adjacent said upper ring;

(b) flow escape means for allowing water to bypass said basket when said mesh bag is clogged with debris; and (c) a speed accelerator plate, said speed accelerator plate having a semicircular opening, said speed accelerator plate planarly aligned with said upper ring, said speed accelerator plate detachably coupled to said upper ring;

(d) wherein said speed accelerator plate detachably and adjustably couples to said upper ring in a first, regular flow position wherein a rounded edge of said semicircular opening is oriented towards the direction of water flow, and a second, accelerated flow position wherein a corner of said semicircular opening is oriented towards said direction of water flow.

19. A pool skimmer apparatus, comprising:

(a) a collapsible skimmer basket, said basket including an upper ring, said basket including a mesh bag depending from said upper ring, said bag having an opening adjacent said upper ring;

(b) flow escape means for allowing water to bypass said basket when said mesh bag is clogged with debris, said flow escape means adjacent said upper ring; and (c) a speed accelerator plate, said speed accelerator plate having a semicircular opening, said speed accelerator plate planarly aligned with said upper ring, said speed accelerator plate detachably coupled to said upper ring;

(d) wherein said speed accelerator plate detachably and adjustably couples to said upper ring in a first, regular flow position wherein a rounded edge of said semicircular opening is oriented towards the direction of water flow, and a second, accelerated flow position wherein a corner of said semicircular opening is oriented towards said direction of water flow.

* * * * *